US006196394B1

(12) United States Patent
Sieg et al.

(10) Patent No.: US 6,196,394 B1
(45) Date of Patent: Mar. 6, 2001

(54) METHOD FOR OPERATING A ROLLER BAR SCREEN

(75) Inventors: Claus-Dieter Sieg, Zeitz; Peter M. Lobeck, Hamburg, both of (DE)

(73) Assignee: Zemag GmbH, Zeitz (DE)

( * ) Notice: Subject to any disclaimer, the term of this patent is extended or adjusted under 35 U.S.C. 154(b) by 0 days.

(21) Appl. No.: 09/485,041

(22) PCT Filed: Jun. 3, 1999

(86) PCT No.: PCT/EP99/03858

§ 371 Date: Apr. 28, 2000

§ 102(e) Date: Apr. 28, 2000

(87) PCT Pub. No.: WO99/64170

PCT Pub. Date: Dec. 16, 1999

(30) Foreign Application Priority Data

Jun. 5, 1998 (DE) ..... 198 25 097

(51) Int. Cl.[7] ..... B07C 5/00; B07B 1/15; B07B 13/18

(52) U.S. Cl. ..... 209/672; 209/552; 209/673; 209/678

(58) Field of Search ..... 209/552, 672, 209/673, 678

(56) References Cited

U.S. PATENT DOCUMENTS 4,658,964 4/1987 Williams .
5,236,093 8/1993 Marrs .
5,503,712 4/1996 Brown .

FOREIGN PATENT DOCUMENTS 40 17 652 12/1991 (DE) .
44 44 235 6/1996 (DE) .

*Primary Examiner*—Donald P Walsh
*Assistant Examiner*—Brett C. Martin
(74) *Attorney, Agent, or Firm*—Collard & Roe, P.C.

(57) ABSTRACT

The invention relates to a method for operating a roller bar screen and to the generation of certain parameters for optimal adaptation to the bulk material being processed and as a prerequisite for process optimization. Construction measures—essentially equipping the rollers with variable speed drive mechanisms—are taken in a first preparatory step. Selected control variables and limit values related to the average characteristics to be expected of the bulk material are generated in a single operation by means of a regulation and process control system. The optimum number of revolutions for each individual roller in particular is predetermined in dependence on the process. The rollers can be grouped together. The dynamics of the roller bar screen are monitored and influenced by a regulating system which is characterized by the following; 1) determination of the quantity of the bulk material, the level of the bulk material in the area of the screen train and the power consumed by the motor as minimal information and determination of other optional information, using sensors; 2) forwarding this information to a processing and evaluating unit; 3) processing and evaluating in the same using known information processing technology and specially developed algorithms, more specifically, determining the screen filling contour and modelling the same and superimposing the information relating to the number of revolutions with periodic functions to obtain various control values; and 4) outputting these control values, essentially information relating to the number of revolutions of the roller drive mechanisms.

3 Claims, 1 Drawing Sheet

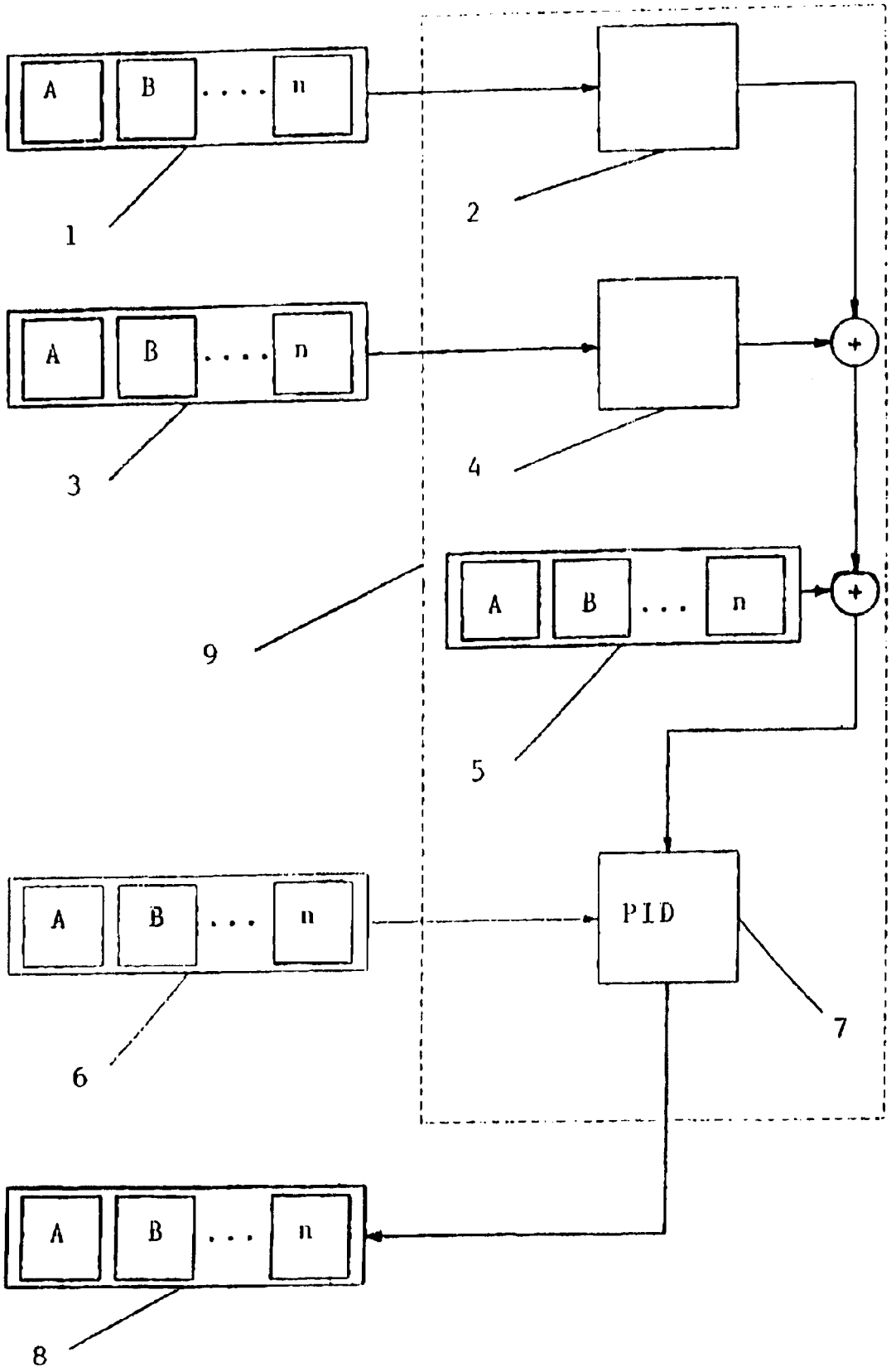
A
B
n
1
2
3
4
9
5
PID
7
6
8

METHOD FOR OPERATING A ROLLER BAR SCREEN

The invention relates to a method of operating a roller grate screen, including the generation of defined parameters.

Roller grate screens consists of a multitude of rollers arranged in sequence in one plane. Individual disks or disk packets are pushed onto the rollers and thus form of screen floor. The disks have substantially circular contours, but other shapes are found as well. The screen rollers are mounted in such a way that the disks of adjacent rollers are either arranged in a row or are offset relative to each other, partly engaging each other, depending on the classification job on hand. The rollers, and therefore the disks rotate in the same sense in the direction of conveyance. Starting from the charging position, the stock to be screened thus either drops as undersized grain material through the screen gap, or it is transported as oversized grain material into the screen overflow, depending on which grain size was selected. Devices operating according to said principle have been known since a long time, and are employed in practical applications in the field of bulk material technology. On the driving side, roller grate screens of the more recent generation are equipped with one drive motor per roller, whereby all rollers rotate at the same rotational speed.

This has the advantage that the motors can be optimally adapted to the load of the associated roller. The rollers at the charging side are logically equipped with larger motors than those located near the screen overflow. In the event of failure of one roller drive, or also of two roller drives not adjacent to each other, the operation of the screen can be temporarily continued, which results in simplified maintenance and servicing.

In connection with multiple arrangements of roller grate screens, the partial screen floors arranged in sequence can be operated with rising speeds of the rollers (DE-OS 40 17 652). The rotational speed of the rollers within each partial screen floor is the same in this connection.

Under current aspects, the prior art described above has the main drawback that the available roller grate screens are not adapted to changing process requirements, or that an adaptation to changing parameters of the screening stock can be realized only with disproportionately high expenditure , i.e. reconstruction of the screen rollers or other components of the screen. The goal of the invention is to eliminate said drawback.

Machines are currently needed worldwide that are capable of reacting to conditions which are determined by the overall process of a bulk material processing plant, or by the environment. The problem of the invention is to apply said basic requirement to a roller grate screen. Concretely, the problem is to make available a roller grate screen that is optimally designed with respect to its actually intended purpose, which is the classification of bulk materials, and also in regard to other properties such as wear, operational safety, friendliness to the environment, noise emission and energy consumption, and which, most of all, will automatically react to changing input parameters. In bulk material technology, these are in particular the parameters of the streams of bulk material. Said streams are naturally not constant, but substantially vary in different time periods to different degrees. The parameters here under discussion are as follows:

- Changing components of screenable fine grains in the charged material, and the grain distribution;
- internal and external moisture conditioned by seasonal and weather variations;

- weather differences;
- nonuniform rate of through-put through the total plant; and
- composition of the bulk material; varying component of foreign materials.

It is known that such technical parameters can be detected, evaluated and processed by control technology at more or less greater expenditure. Modern control and regulating technology is available for said purpose. This has not been the case heretofore in connection with roller grate screens.

Therefore, the following process steps are proposed according to the invention for generating and controlling a roller grate screen of the type specified above.

The generation of selected control quantities and limit values based on the average bulk material properties to be expected, through constructional measures and pre-adjustment has to be viewed as the first step. In addition to engineering measures, the generation measures include particularly also equipping of the rollers with variable-speed drives, and process-dependent presetting of the optimal rotational speed for each individual roller, or for electrically combined groups of rollers. The second process step involves process-relevant influencing of the mode of operation of the roller grate screen in that provision is made for controlling the rotational speed of each individual roller, or group of rollers. For this purpose, one or several of the measured values specified below are either acquired continually by means of sensors, or periodically if the measured quantity changes only gradually:

- Determination of the quantities of bulk material present in the individual zones of the screen by detecting the filling levels;
- detection of the torque in the drives, or of the motor current consumption;
- rate of revolutions of the rollers;
- temperature of the bulk material;
- moisture of the bulk material;
- physical analytic values relating to the grain size and grain distribution;
- chemical analytic values relating to the composition of the bulk material.

The above enumeration corresponds with the maximum information requirement. Substantially fewer sensors are needed in the specific case of practical application, namely those that are needed for the classification job to be done, and which are economically justifiable.

The method at least requires continuous measuring of the quantities of bulk material, the number of revolutions and the torque, or motor current consumption. Other specified parameters can be detected and evaluated if the properties of the bulk material very frequently and briefly deviate from said parameters in terms of time.

The process information is evaluated, using known information processing technology and specially developed algorithms, specifically continuous determination of the screen occupancy contour, thus the determination of the level of the bulk material in the individual zones of the screen; reproduction of said contour in a mathematical model for control and linearization, thus control-technical influencing of the roller rates of revolution with the target to create such screen loading contour linear over the entire length of the screen; and then processed to rated speed information which is transmitted to the individual drives or groups of drives. The purpose of such control is to ensure that the entire length of the screen is optimally exploited even in the presence of instantaneously low through-put rates.

For increasing the screening effect it is possible to modulate said rated speed information with period functions (for example sinus function), which are generated phase-shifted for the individual drives or groups of drives. It was found that it is advantageous if the drives are combined in groups, each group comprising two, three or more drives. Each drive of a group then receives the same rated speed information. As a supplementary measure, the rated and the actual rates of revolution are compared by means of known speed controllers (PID's), and re-adjusted if load-conditioned deviations have occurred.

Viewing the proposed steps of the method and the technical means together it becomes clear that it is possible with application of the method as defined by the invention to further develop the roller grate screens—which are known per se—to so-called intelligent machines, which is connected with positive economical effects due to higher efficiency.

The invention is explained in greater detail in the following with the help of a drawing, which shows the aforementioned control by a block circuit diagram. The individual blocks are denoted by the following reference numerals and letters:

1 Sensors for detecting the contour (filling level);

2 Signal evaluation for contour information;

3 Sensors for detecting additional process information;

4 Signal evaluation for additional process information;

5 Generator for generating periodic information;

6 Sensors for detecting the actual rotational speed;

7 Rotational speed controller;

8 Drives; groups of drives;

9 Controlling and regulating device;

A,B, . . . n Symbolic representation of the allocation of the drive groups.

The generation measures are adequately explained in the above description, so that no further statements are required in their regard.

The following is stated in regard to the control of the roller grate screen: when operating a roller grate screen according to the prior art, a bulk material contour develops, i.e. the surface of the bulk material slightly slopes from the charging side in the direction of the overflow of the screen. With uncontrolled roller grate screens, said slope reaches up to a point in the second half of the roller grate screen that is dependent upon the instantaneous amount of bulk material present, and the rotational speed of the rollers. From said point on, the surface of the bulk material extends parallel with the surface formed by the screen rollers. This leads to the conclusion that notable amounts of fine grains are no longer screened in said zone.

A poorer screening result is obtained in said zone, combined with a poorer screening quality because bulk material particles sized by one dimension larger than the fraction of bulk material to be screened off are partly allowed to pass through the screen, for example like a match that is pushed through a small opening though which only peas should actually drop.

Said bulk material contour (=the size to be controlled) is shaped by the method as defined by the invention through optimal adaptation of the rotation speed of the rollers, in a way such that a constant contour of the stock to be screened is obtained. This means that the fine grains are always screened off across the entire roller grate screen irrespective of the instantaneously charged amount of bulk material. The screening result is complete exactly on the last roller. The aforementioned one-dimensional particles of the bulk material, for example, have only a slight chance of passing through the screen.

The consequence of the way in which the operation of the roller grate screen is controlled as defined by the invention is that the screen is operated at 100% rotational speed of the rollers only in exceptional cases. The rotational speed of the rollers is reduced in all other instances, which leads to a noticeable reduction of the wear.

What is claimed is:

1. A method of operating a roller grate screen, characterized in that constructional measures substantially in the form of equipping the rollers with variable-speed drives are implemented in a preparatory step, and, furthermore, selected control and limit values are generated once based on the average properties of the bulk material to be expected, by means of a process control and regulation system, whereby the optimal number of revolutions is preset for each individual roller depending on the process; and that the dynamics of said roller grate screen is influenced by a control procedure having the following features:

Detection of the bulk material quantity by multi-point measurement of the filling level in the zone of the screen train, as well as of the actual motor outputs by measuring the motor current consumption, as minimum information in addition to other optional information, by means of sensors;

Forwarding of said information to control-internal processing and evaluation units;

Information processing technology with specially developed algorithms, more specifically modeling of the screen filling contour as well as derivation of the control values for adapting the numbers of revolutions of the rollers;

Superimposing of the determined rotational speed values with period or non-periodic functions, with calculation of the nominal rotational speed values based thereon;

Outputting of said nominal rotational speed values to the roller drives; and

Controlling of the number of revolutions of the rollers with inclusion of the actual rotational speed values.

2. The method according to claim 1, characterized in that ideal number of revolutions is preset in each case for one group of rollers preferably consisting of three rollers; and that the nominal rotational speed information is transmitted within the control system to the motors of the roller groups as well.

3. The method according to claim 1, characterized in that for the control, the bulk material moisture, the torque in the drive system, the actual rotational speed of the rollers, the grain size/grain distribution, the temperature and/or the compositions of the bulk material are directly or indirectly detected by means of sensors as optional information.

* * * * *